United States Patent [19]

Hornby

[11] 4,412,475

[45] Nov. 1, 1983

[54] AIRCRAFT ROCKET AND MISSILE LAUNCHER

[75] Inventor: Thomas W. Hornby, Mesa, Ariz.

[73] Assignee: Northrop Corporation, Hawthorne, Calif.

[21] Appl. No.: 153,314

[22] Filed: May 27, 1980

[51] Int. Cl.[3] ..... F41F 3/06

[52] U.S. Cl. ..... 89/1.816; 89/1.5 B; 89/1.5 G; 244/137 R

[58] Field of Search ..... 89/1.815, 1.816, 1.817, 89/1.8, 1.806, 1.811, 1.5 B, 1.5 G; 206/317; 244/137 R

[56] References Cited

U.S. PATENT DOCUMENTS

| | | | |
|---|---|---|---|
| 2,461,406 | 2/1949 | Birk et al. | 89/1.5 B |
| 2,699,908 | 1/1955 | Fletcher | 89/1.5 G X |
| 2,858,737 | 11/1958 | Tolomeo | 89/1.815 X |
| 2,951,664 | 9/1960 | Smith | 89/1.8 X |
| 2,958,260 | 11/1960 | Anderson | 89/1.815 X |
| 3,167,278 | 1/1965 | Roberge | 89/1.815 X |
| 3,181,908 | 5/1965 | Clark | 89/1.5 R X |
| 3,185,035 | 5/1965 | Gregory-Humphries | 89/1.815 |
| 3,608,423 | 9/1971 | Nash | 89/1.807 |
| 3,710,678 | 1/1973 | Abelin et al. | 89/1.816 |

*Primary Examiner*—David H. Brown

*Attorney, Agent, or Firm*—William W. Rundle; Robert J. Stern; John E. Peele, Jr.

[57] ABSTRACT

A jettisonable missile launcher pod has support lugs which extend upwardly through a relatively small separate hardback structure to latch into standard release hooks in an aircraft-mounted pylon. The hardback is adjustably attached to the pylon and contains the required high technology electronic gear for the missile system. When the pod is jettisoned, it drops from the release hooks as usual, but the electronic gear remains with the aircraft in the hardback. The hardback is shaped as a thin top section or portion of a conventional launcher pod.

9 Claims, 2 Drawing Figures

AIRCRAFT ROCKET AND MISSILE LAUNCHER

BACKGROUND OF THE INVENTION

1. Field of the Invention

The present invention relates to external aircraft stores such as airborne rocket and missile launchers, and more particularly, to a means and method of jettisoning a missile launcher from an aircraft without also jettisoning expensive electronic equipment along with the launcher.

Standard practice in the design of rocket and missile launchers carried by aircraft has been to make them lightweight and strong, yet low in cost so that in the event of aircraft combat involvement, for example, the launcher or pod may be jettisoned in order to substantially lessen aerodynamic drag and weight. Now with the existence of high technology range finders, fuzing systems and other electronic devices installed in the launcher pod, there is much expensive equipment lost when it is decided that the launcher must be jettisoned. The problem of boresighting each new launcher, when installed, must also be taken into account at the time of reloading after the previous pod assembly has been jettisoned.

2. Description of the Prior Art

U.S. Pat. No. 3,185,035 to Gregory-Humphries discloses a standard rocket launcher attached to an aircraft wing-mounted pylon. A supplementary launcher is removably fit on the standard launcher for the purpose of carrying a larger number of rockets. The launchers are not jettisonable.

U.S. Pat. No. 3,167,278 to Roberge shows a mounting probe suspended horizontally beneath an aircraft wing for providing easy installation of an ordnance carrier (launcher) thereon during air-to-air transfer.

U.S. Pat. No. 3,710,678 is typical of those which show a jettisonable pod for aircraft carried rockets.

The concept of providing an adjustable (boresightable) "hardback" on which to install launchers or pods is also believed to be known. If and when the launcher is jettisoned, so is the hardback.

SUMMARY OF THE INVENTION

It is an object of this invention to provide a means and method of jettisoning a missile launcher and missiles therein, if any, without also dropping expensive or sophisticated electronic gear at the same time.

A further object of the present invention is to eliminate the necessity of boresighting a jettisonable missile launcher to its carrier aircraft each time a launcher is loaded upon the aircraft after jettisoning the previous launcher.

Briefly, my invention comprises a low-drag hardback for affixing to an aircraft carried pylon or the like, and an inexpensive launcher pod or the like fitting up against the hardback but attached only by tension members passing through the hardback to connect to releasable hook means in the pylon. Space for electronic hardware associated with missile firing and operation is located in the hardback which remains with the aircraft if or when the launcher is released from the hook means. The launcher is preferably made to fit the standard release racks in the aircraft. The hardback is preferably attached to the aircraft pylon or other mounting structure by adjustable means providing boresight alignment.

DESCRIPTION OF THE PREFERRED EMBODIMENT

Figure 1:
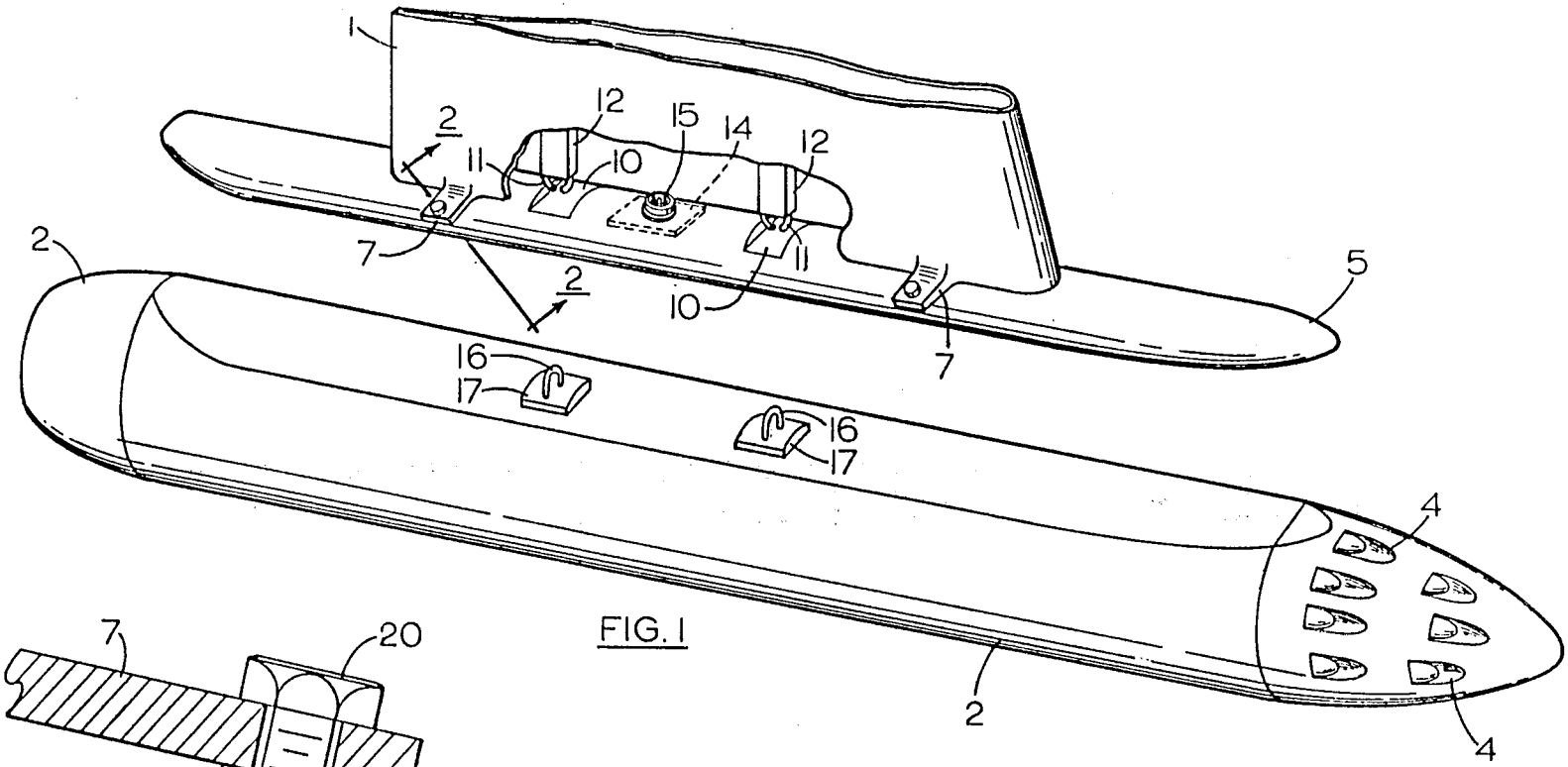
FIG. 1 is an exploded perspective view of a rocket launcher pod and an adjustable hardback attached to an aircraft wing pylon, showing the overall arrangement of the present invention.

Referring to FIG. 1, a pylon member 1 is suspended from the wing, for example, or an airplane (not shown). A jettisonable missile launcher, such as a rocket pod 2, is designed to be carried by the pylon 1. A number of rocket tubes 4 are provided in the pod 2 as is common, for loading of rockets therein.

Instead of the rocket pod 2 being hung directly against the pylon 1 as in conventional systems, a separate "hardback" shell-like structure 5 is provided in the present invention. This hardback 5 is preferably of a streamlined, lightweight design which may comprise a small top section, only, of a generally cylindrical shape pod 2. Bolts from four sway braces 7 attached to the pylon 1 hold the hardback 5 adjustably but firmly in place. Details of this attachment will be described later.

Two rectangular openings 10, for example, are provided vertically through the hardback 5 directly beneath positions in the pylon 1 where attachment hooks 11 are installed. Hooks 11 are part of standard release shackles 12 used to jettison various types of exterior supplemental equipment.

The hardback 5 carries selected electronic or other operational equipment 14 therein, which is associated with the rockets or other missiles to be fired from the launcher 2. This may be equipment which is relatively expensive and valuable, such as range finders, electronic fuzing components, guidance equipment or the like. It is connected back into the aircraft through the pylon 1 by means of a suitable multi-pin electrical connector 15, for example.

The launcher or pod 2 itself carries only the rockets installed in the tubes 4 and their launching and/or arming wires, for example. The upper side of pod 2 is truncated to match the lower surface of the hardback 5, and two raised attachment lugs 16 are provided projecting upward from the pod 2. The lugs 16 are positioned to extend through the hardback openings 10 and hang from the support hooks 11 in the pylon 2. The width of the hardback 5 preferably matches the width of the upper surface of the pod 2 so that a smooth continuation of the pod 2 is afforded by the hardback 5 when the two are connected together.

The hanger lugs 16 may be mounted on filler structure 17 which exactly fits the respective openings 10 in the hardback 5, as shown in FIG. 1, thus giving a flush upper surface to the hardback 5.

Figure 2:
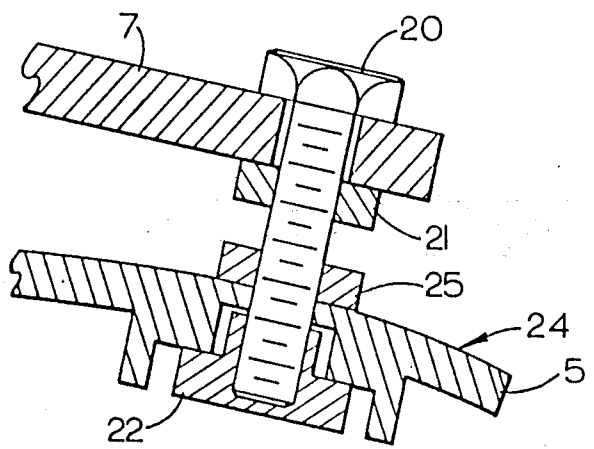
FIG. 2 is a detailed sectional view of the hardback attachment to the pylon.

Referring now to FIG. 2, details are shown of one particular attachment scheme of the hardback 5 to the pylon 1. All four attachments are identical. A standard bolt 20 passes through a hole near the end of each sway brace 7 and has a lock nut 21 tightened against the lower side of the sway brace 7 when the final adjustable position of the hardback 5 is obtained. The bolt 20 is threaded into a floating nut 22 beneath the upper surface 24 of the hardback 5, with a jam nut 25 being provided on the bolt 20 to lock the adjustment.

The hardback is boresighted into proper position with a pod 2 installed, for example, and thus another pod may be later installed (if the first one is jettisoned) without repeating the boresighting procedure. This is possible since each identical pod 2 is built to fit in only one indexed position against the hardback 5. Suitable indexing means (not shown) can easily be provided for this function.

Modifications may obviously be made in the adjustable attachment apparatus illustrated in FIG. 2 within the scope of this invention.

Thus it is seen that the launcher pod 2 can be jettisoned from the release hooks 11 while the streamlined hardback 5 remains attached to the pylon 1, and the sophisticated electronic equipment 14 in the hardback 5 is not wasted. The present invention is easily and economically incorporated since no alterations to the aircraft or pylon 1 are required except that the four normally-used sway brace pads are replaced by the standard bolts and nuts shown in FIG. 2.

The necessary electrical connections between the hardback 5 and the missiles in the launcher are provided by means of suitable electrical cables and pull-apart connectors (not shown), where needed.

What is claimed is:

1. Missile launcher apparatus for carrying missiles on an aircraft having a pylon member and release hook means mounted in said pylon member, the apparatus comprising:

a hardback portion fixable adjustably to said pylon member and having spaced lug receiving openings therethrough;

a jettisonable missile launcher portion for holding and firing a plurality of missiles therefrom, having support lug means arranged in spaced relation on the upper side thereof, and an upper surface configuration for receiving said hardback portion, said launcher portion having an installed position abutting the lower side of said hardback portion with said lugs of said launcher portion positioned through said lug receiving openings in said hardback portion for engagement with said hook means of said aircraft, and release therefrom.

2. Apparatus in accordance with claim 1 wherein said missile launcher portion is of a generally cylindrical shape, having a substantially horizontal section near the top for mating said launcher portion and said hardback portion.

3. Missile launcher apparatus as in claim 1 including structure to which said lug means is attached projecting upwardly from the upper side of said missile launcher portion, and into said lug receiving openings in said hardback portion to form a closed flush upper surface on said hardback portion.

4. Apparatus as in claim 1 wherein said hardback portion is configured as a substantially flat elongated member securable to said sway brace means for adjustment relative to the pylon member of the aircraft.

5. Apparatus in accordance with claim 1 including electronic missile equipment mounted in said hardback portion.

6. Apparatus in accordance with claim 5 wherein said electronic missile equipment in said hardback portion which remains therein when said missile launcher portion is jettisoned upon release from said hardback portion.

7. Apparatus in accordance with claim 1 including adjustable fastening means between said hardback portion and said pylon whereby said launcher portion, when in the installed position, can be boresighted with respect to said aircraft.

8. Apparatus in accordance with claim 7 wherein said adjustable fastening means comprises a plurality of sway braces symmetrically attached to said pylon, a floating nut positioned in said hardback portion in line with the outer end of each said sway brace, and adjustable-length bolt means connecting said sway braces respectively to said floating nuts.

9. A missile pod assembly for use on an aircraft having a pylon member with release hooks therein, for releasably retaining stores externally of said aircraft, comprising: a generally cylindrical pod having a plurality of missile holding and launching means therein, the upper side of said cylindrical pod being truncated to leave a substantially flat upper surface, support lug means extending upwardly from said upper surface to engage with the release hooks in the aircraft pylon, and an elongated hardback member adjustably attached on said pylon member, and having openings through which said support lug means protrude said hardback member containing space for mounting therein electronic equipment to be retained with the aircraft upon release of said generally cylindrical pod from the hardback member.

* * * * *